United States Patent [19]

Shaw

[11] Patent Number: 4,832,091

[45] Date of Patent: May 23, 1989

[54] METHOD AND MECHANISM FOR REPAIRING THE WEFT SUPPLY ON WEAVING MACHINES IN CASE OF AN INTERRUPTION BETWEEN THE SUPPLY PACKAGE AND THE WEFT ACCUMULATOR

[75] Inventor: Henry Shaw, Vleteren, Belgium

[73] Assignee: Picanol N. V., Ieper, Belgium

[21] Appl. No.: 113,075

[22] Filed: Oct. 27, 1987

[30] Foreign Application Priority Data

Oct. 29, 1986 [NL] Netherlands ..... 8602724

[51] Int. Cl.[4] ..... D03D 47/36

[52] U.S. Cl. ..... 139/450; 139/452

[58] Field of Search ..... 139/1 R, 11, 116, 429, 139/450, 452

[56] References Cited

U.S. PATENT DOCUMENTS

| | | | |
|---|---|---|---|
| 4,658,866 | 4/1987 | Takegawa | 139/450 |
| 4,711,273 | 12/1987 | Kato et al. | 139/450 |
| 4,756,341 | 7/1988 | Takehana | 139/452 |

*Primary Examiner*—Henry S. Jaudon

*Attorney, Agent, or Firm*—Bacon & Thomas

[57] ABSTRACT

Method for repairing the thread supply in weaving machines in the event of an interruption between the weft thread supply package and the weft accumulator, with the characteristic that it consists essentially of: seizing an existing thread portion at a particular point of the thread supply on the weft accumulator drum; removing the portion of thread between this point and the point of the interruption; taking a new thread end from the same weft thread supply package or another and leading it to the old weft thread end; and joining the new end to the old end.

13 Claims, 5 Drawing Sheets

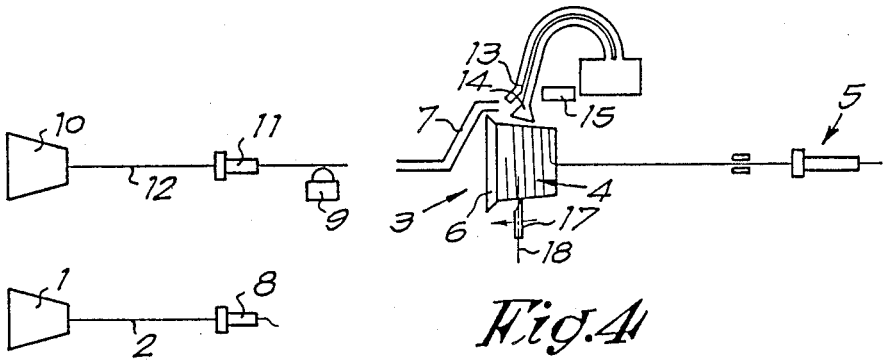
Fig.4
Fig.5
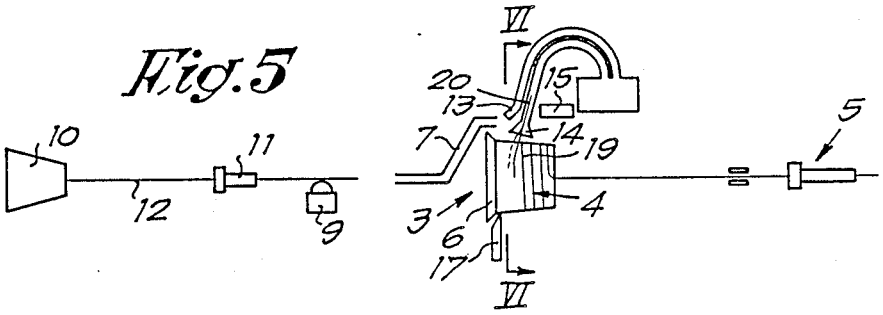
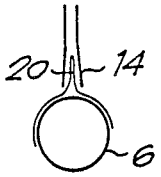
Fig.6

Fig. 9
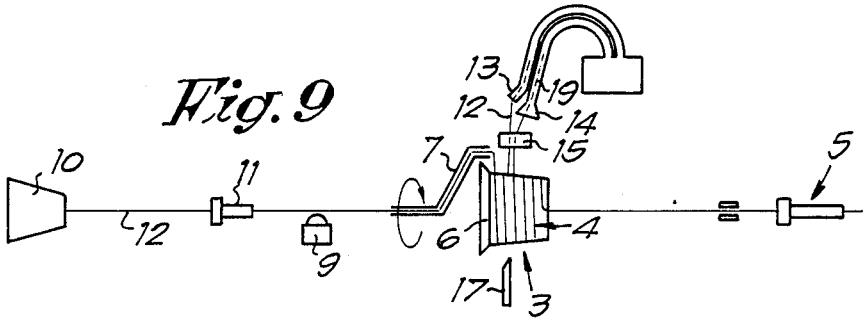
Fig. 10
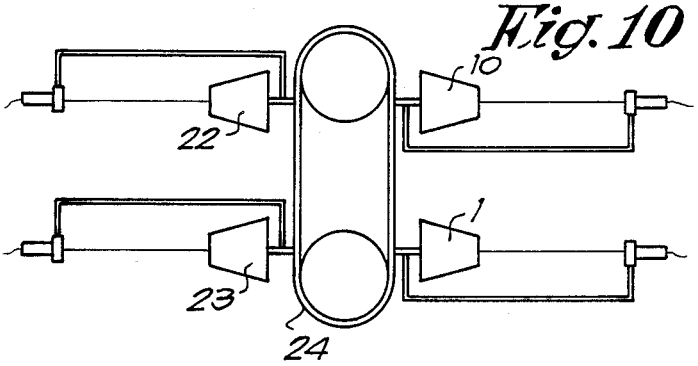
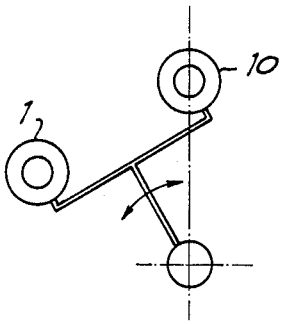
Fig. 11
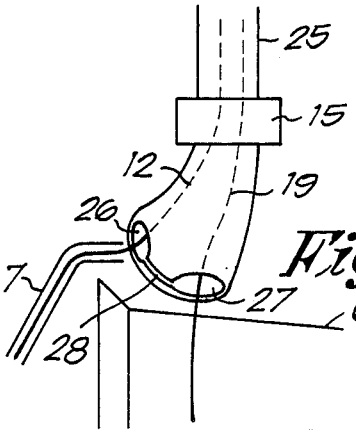
Fig. 12
Fig. 13
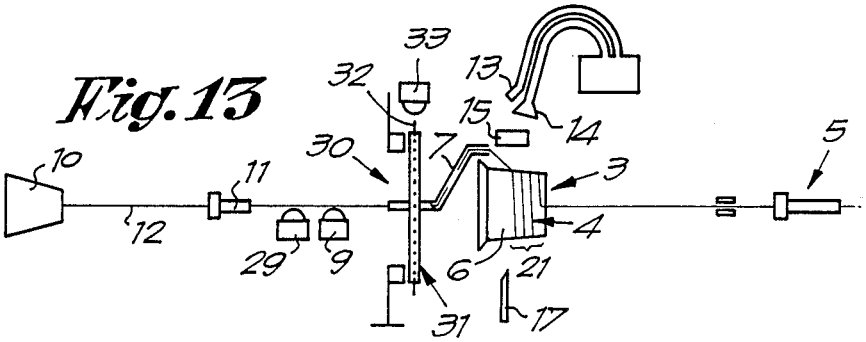

METHOD AND MECHANISM FOR REPAIRING THE WEFT SUPPLY ON WEAVING MACHINES IN CASE OF AN INTERRUPTION BETWEEN THE SUPPLY PACKAGE AND THE WEFT ACCUMULATOR

BACKGROUND OF THE INVENTION

This invention concerns a method for repairing the weft thread supply in weaving machines in the event of an interruption of the thread somewhere between the supply package and the weft accumulator, together with a mechanism that performs this method.

Such an interruption can occur as a result of a thread break or a supply package of weft thread running out before a new package has been connected. With systems known to date, when such an interruption in the weft thread occurs, the weaving machine has to be stopped and the weft accumulator and main nozzle switched off, or, in the case of a rapier machine, the thread presentation gripper has to be rethreaded and/or another weft accumulator has to be activated.

SUMMARY OF THE INVENTION

The present invention concerns a method for repairing the interruption in the weft supply which makes the complicated rethreading process of the prior art unnecessary. This is achieved by repairing the weft supply before the broken thread leaves the accumulator.

In order to achieve this, the method of the invention consists essentially of: seizing the thread at a particular point of the weft thread supply accumulated on the weft thread accumulator; removing the piece of thread between that point and the break in the weft thread; taking a new thread end from the same supply package of weft thread or another and bringing it up to the end of the weft thread which has been seized; and joining the two ends together.

This invention also concerns mechanisms for carrying out this procedure.

BRIEF DESCRIPTION OF THE DRAWINGS

In order to explain the characteristics of the invention, for the sake of example only and without being limitative in any way, the method and some mechanisms based on the invention are described below with reference to the accompanying drawings, where:

FIGS. 1–9 are schematic representations of the steps involved in the method of the invention, implemented on a weaving machine which uses a conventional weft accumulator of the type that consists of a prewinder drum and a winding tube, a weft thread supply and a pick insertion device;

FIGS. 10–11 show two embodiments for mounting bobbins for use in the present invention;

FIG. 12 shows an alternative embodiment of the arrangement of the suction nozzles and the tying-in device of the invention;

FIG. 13 shows an alternative embodiment of the winding tube of the invention.

DESCRIPTION OF THE PREFERRED EMBODIMENTS

Figure 1:
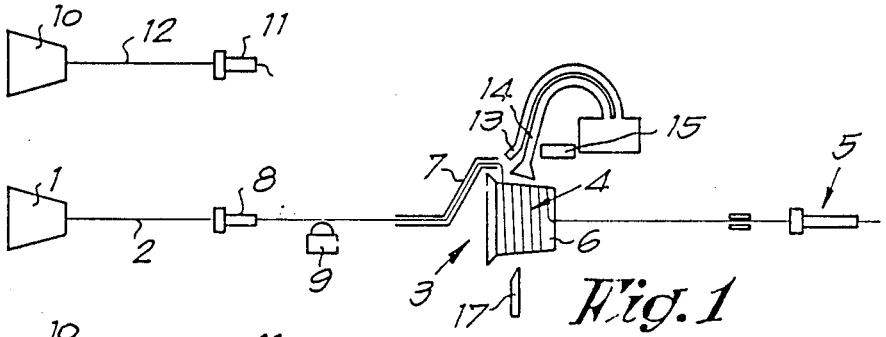

FIG. 1 shows a mechanism basd on the invention in normal operation. Here, the thread 2 is taken from the weft supply package 1 in any known manner and is led to a conventional weft accumulator 3 where a thread supply 4 is formed in order to enable the weft insertion device 5 to be supplied intermittently with the accumulated thread for picking into the shed in a manner known in the art. In the embodiment shown in the diagram, the weft accumulator 3 consists essentially of a fixed prewinder drum 6 and a rotating winding tube 7. In the case of airjet weaving machines, the weft insertion device 5 consists of a conventional injector nozzle. The mechanism also includes a conventional auxillary nozzle 8 which is used in any known manner to thread the winding tube 7, and a conventional thread break detector 9.

The mechanism also consists of one or more reserve packages of weft thread 10, together with a mechanism 11 such as a conventional auxiliary nozzle for presenting the reserve package of weft thread to the weft accumulator 3 at the required moment.

Two suction nozzles 13 and 14 and a conventional tying-in device 15 are mounted on the loom structure in any known manner adjacent to the weft accumulator 3.

Figure 2:
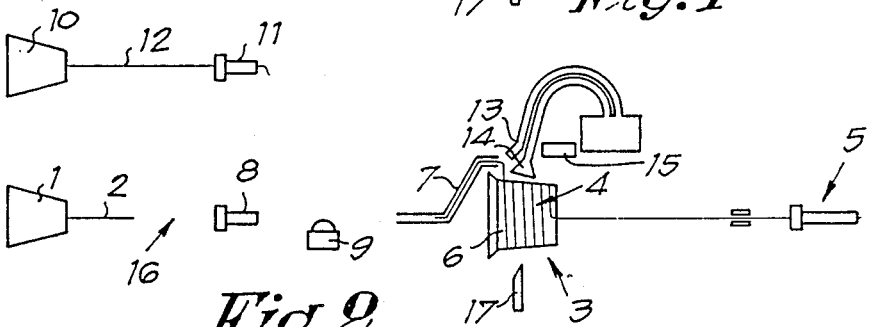
Figure 3:
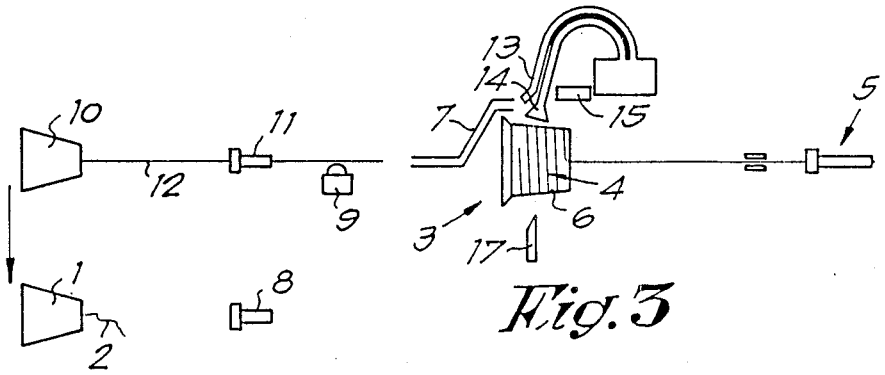

When an interruption 16 (FIG. 2) in the weft thread occurs, it is detected in a known manner by the thead break detector 9, causing the loom control means (not shown) to automatically present the weft thread from the reserve package 10 to the winding tube 7, as shown in FIG. 3, in a manner known in the prior art fo providing a continuous supply of weft thread to a weaving loom during the weaving operation.

At the same time, the thread supply 4 on the accumulator drum is automatically cut at a predetermined point by means of a cutting device 17 positioned in any known manner relative to the axis of the drum; and all the coils to the left of the predetermined point at the line 18 on the underneath side of the prewinding drum 6 are cut through by moving the cutting device to the left in any known manner, as shown in FIG. 4. Since the thread supply 4 to the left of the predetermined point on the accumulator is cut, the remaining part 19 of the thread supply 4 on the drum is almost certainly of good quality. Where a break occurs in the thead 2, it is almost always caused by a bad length of thread; by removing the part 20 of the thread to the left of the predetermined point 18, there is a good chance that the faulty length of weft thread will be removed completely.

As shown in FIGS. 5 and 6, the resulting thread pieces 20 cut free from the accumulator are sucked up by the suction nozzle 14. If there should happen to be a loose piece of thread in the winding tube 7, this is also sucked up by suction nozzle 14; to this end, the rotation of the winding tube 7 can be automatically halted on detection of a weft break so that its end is positioned just before or close to the suction opening 13 by use of a brake to be described later. However, there is no reason why the winding tube 7 should not continue to rotate.

Figure 7:
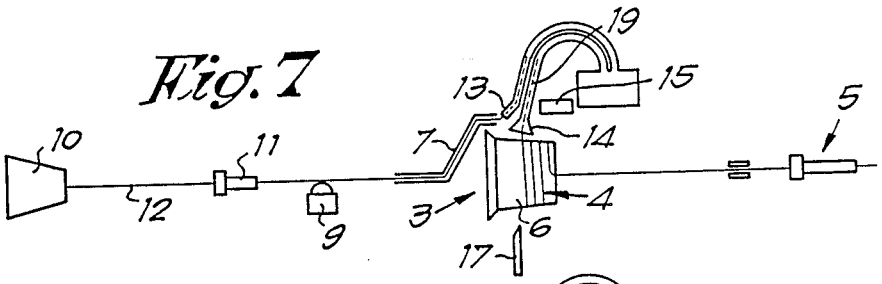

As shown in FIG. 7, the new supply of weft thread 12 is led to suction nozzle 13 by the auxiliary nozzle in a manner known in the art, while the shortened length of the cut thread 19 extends from the top of the drum as it is drawn into suction nozzle 14, where it is held fast.

Figure 8:
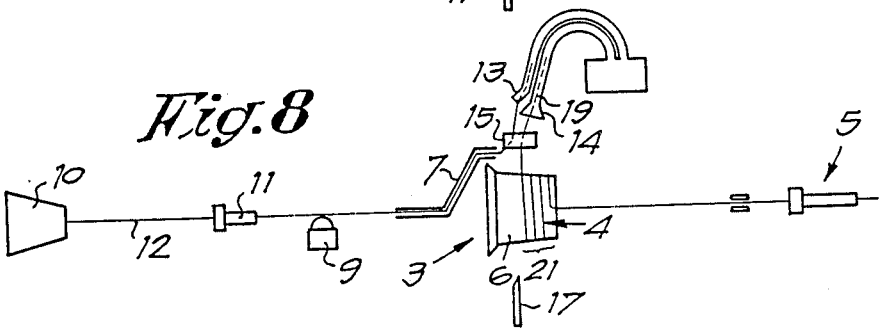
Figure 14:
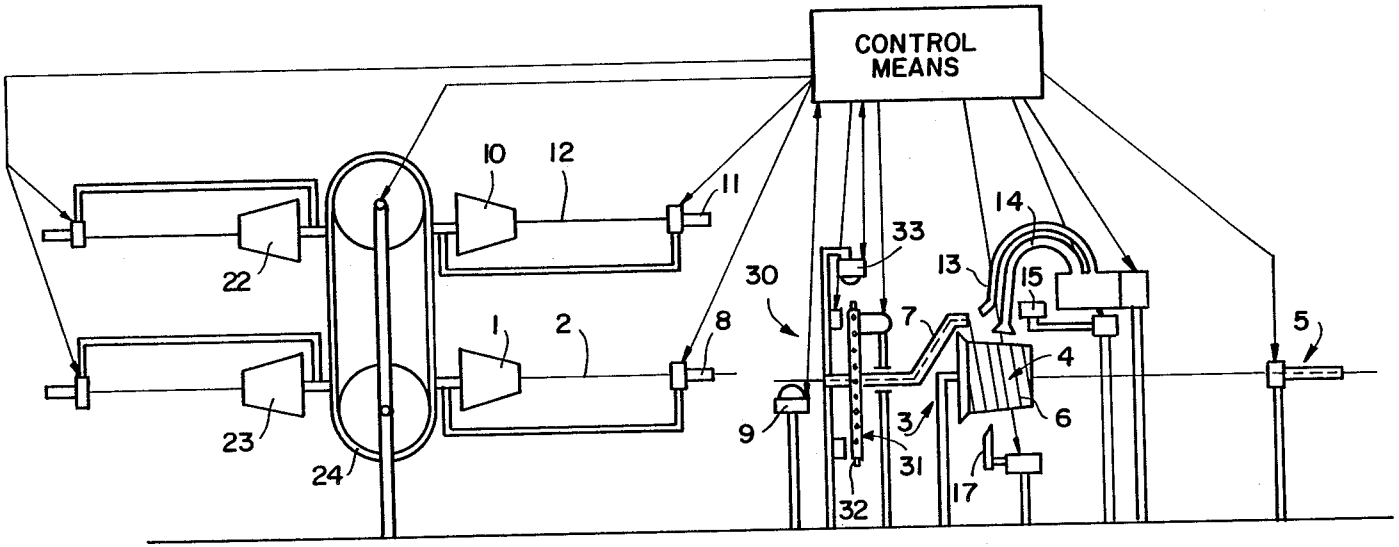

The suction nozzles 13 and 14 can then be automatically raised over a short distance as shown in FIG. 8, so that a conventional tying-in device 15 can join the thread 12 and the thread end 19. Once this join has been made, winding of the thread 12 onto the prewinder drum 6 can continue.

In an alternative embodiment (not shown in the figures), instead of cutting the thread part 19 on the prewinder drum 6, the drum is turned back a few turns so that the thread part 19 is unwound from the drum and is sucked up over a short distance into nozzle 14, thus ensuring that the thread part 19 is joined at a point where the thread is good. The extra length of thread formed when the joint is made can be cut off automatically in any known manner.

If the automatic reaction speed is fast enough after detection of the weft thread interrupt, the thread section 19 can be held fast or sucked up immediately on leaving the winding tube 7.

Clearly, if the remaining thread supply 21 on the accumulator drum is made sufficiently great, the weaving process can continue without being hindered by the repair operations.

In the embodiment shown in FIG. 9, winding of the thread 12 on the prewinding drum 6 begins again while the tying-in device 15 is still operating.

In order to facilitate the changing of weft thread supply packages, changing can be done using systems such as those shown in FIGS. 10 and 11. In the first system, the packages 1, 10, 22 and 23 are placed on a conveyor belt 24. As the belt 24 is rotated, the packages are brought to supply positions relative to the winding tube 7. In the second system, packages 1 and 10 for example can be mounted on a swivel frame so that the thread on either package can be easily presented relative to the winding tube 7 by arcuate movement of the frame to a supply position relative to the winding tube.

FIG. 12 shows an alternative embodiemnt of the suction nozzles of the invention, in which the suction nozzles 13 and 14 are replaced by one common suction nozzle 25 with two suction openings 26 and 27 connected by a slit 28. A known tying-in device 15 can be mounted inside the suction nozzle 15 in any known manner.

FIG. 13 shows yet another embodiment of the mechanism of the invention, in which in addition to the thread break detector 9 there is also a conventional thread motion detector 29. This makes it possible to detect thread breaks which occur after the detector 9 for instance in the winding tube 7.

The winding tube 7 can also be fitted with a disc brake 30 in order to stop the winding tube at a predetermined correct point. Markings 32 can be placed on the brake disk 31 to enable the motion and/or position of the winding tube 7 to be monitored in any known manner by means of a detector 33, thereby permitting the winding tube to be stopped at a position adjacent the suction nozzle 13 as discussed above.

Thread detectors may also be mounted in the winding tube 7 and in the suction nozzles 13 and 14. Clearly, the coils remaining on the prewinding drum 6 can be moved along the drum so that they lie close to the new coils.

Although the preceding description relates to a weft accumulator of the type that consists of a prewinder drum and a winding tube, the method of the invention can obviously be used for any other type of weft accumulator, e.g., the free loop type. The cutting device 17 may consist of either a knife or a pair of shear. Mechanical clamps also be used instead of the suction nozzles 13 and 14 in order to bring the two yarn ends together in the tying-in device 15.

The present invention is not limited to the embodiments described herein by way of example and shown in the accompanying figures; on the contrary, such a method and the mechanism for applying it can be implemented in, any variants while still remaining within the scope of the invention.

I claim:

1. A method of repairing a weft thread break in a weaving loom on detection of a weft thread break occurring in the length of weft thread supplied from a source of weft thread to a weft thread accumulating device of the weaving loom, the method comprising the steps of:

cutting the weft thread accumulated in the accumulating device at a predetermined point along the length of the weft thread;

removing the portion of the weft thread between the cut and the break in the weft thread;

supplying the weft thread end remaining from the break or a weft thread end from a new source of weft thread to the cut end of the weft thread;

and joining the supplied weft thread end to the cut weft thread end.

2. A method as claimed in claim 1 including joining the supplied weft thread end to the cut weft thread end by drawing both ends into a tying-in device.

3. A method as claimed in claim 1 including continuing to accumulate weft thread in the accumulator during at least a portion of the weft thread repair by supplying the supplied weft thread to the cut weft thread end through a winding tube of the accumulator and rotating the winding tube around a fixed drum of the accumulator during at least a portion of the weft thread repair.

4. An apparatus for repairing a weft thread break in a weaving loom on detection of a weft thread break occurring in a length of weft thread supplied from a source of weft thread to a weft thread accumulating device of the weaving loom comprising:

an accumulating device having a winding drum arranged to accumulate weft thread in coils around the surface of the drum and a winding tube arranged to receive weft thread supplied from said source and to supply the thread to said drum through said tube;

a suction device arranged adjacent to the surface of the drum and having two suction openings connected together by a slit opening, with the first suction opening arranged to draw the end of the supplied weft thread remaining from the break through the winding tube and into the first opening, and the second suction opening arranged to draw an end of the weft thread accumulated on the drum into the second opening; and a tying-in device arranged to supplied with the end of the supplied weft thread and the end of the accumulated weft thread drawn through the first and second openings respectively, and to join the two ends of the weft threads together.

5. An apparatus as claimed in claim 4 further comprising a cutting device arranged on the opposite side of the winding drum from the suction device to cut through at least one coil of weft thread accumulated on the drum on detection of a weft thread break.

6. An apparatus as claimed in claim 4 wherein the winding tube is arranged to supply the weft thread to said drum by rotating around the surface of said drum; and including a brake means arranged to brake the winding tube in a predetermined position relative to the suction device on detection of a weft thread break.

7. An apparatus as claimed in claim 6 wherein said brake means comprises a disk fixed for rotation with said winding tube and having a series of markings spatially arranged around the circumference of said disk; and a detection means arranged adjacent to the cirumference of the disk to detect the markings passing the detection means on rotation of the disk.

8. An apparatus as claimed in claim 4 further comprising a thread motion detection means and a thread break detection means arranged adjacent to the length of weft thread supplied from the source of weft thread to the weft thread accumulating device to detect a break in the length of weft thread.

9. An apparatus for repairing a weft thread break in a weaving loom on detection of a weft thread break occurring in a length of weft thread supplied from a source of weft thread to a weft accumulating device of the weaving loom comprising:

an accumulating device having a fixed winding drum arranged to accumulate weft thread in coils around the surface of the drum and a rotating winding tube arranged to receive weft thread supplied from said source and to supply the thread to said drum through said tube;

a first suction nozzle arranged to draw the end of the supplied weft thread remaining from the break through the winding tube and into the first nozzle;

a second suction nozzle adjacent to the first suction nozzle and arranged to draw an end of the weft thread accumulated on the winding drum of the accumulating device into the second nozzle;

and a tying-in device adjacent to the first and second suction nozzles and arranged to join together the two ends of the weft threads drawn into the first and second nozzles.

10. An apparatus as claimed in claim 9 further comprising a cutting device arranged on the opposite side of the winding drum from the first and second nozzles to cut through at least one coil of weft thread accumulated on the drum on detection of a weft thread break.

11. An apparatus as claimed in claim 9 wherein the rotating winding tube is arranged to accumulate coils of weft thread on said drum by rotating around the surface of said drum; and including a brake means arranged to brake the rotating winding tube in a predetermined position relative to the first suction nozzle on detection of a weft thread break.

12. An apparatus as claimed in claim 11 wherein said brake means comprises a disk fixed for rotation with said rotating winding tube and having a series of markings spatially arranged around the circumference of said disk; and including a detection means arranged adjacent to the circumference of the disk to detect the markings passing the detection means on rotation of the disk.

13. An apparatus as claimed in claim 9 further comprising a thread motion detection means and a thread break detection means arranged adjacent to the length of weft thread supplied from the source of weft thread to the weft thread accumulating device to detect a break in the length of weft thread.

* * * * *